US011371413B2

(12) United States Patent
Asano

(10) Patent No.: US 11,371,413 B2
(45) Date of Patent: Jun. 28, 2022

(54) MUFFLER FOR VEHICLE

(71) Applicant: TOYOTA JIDOSHA KABUSHIKI KAISHA, Aichi-ken (JP)

(72) Inventor: Masashi Asano, Okazaki (JP)

(73) Assignee: TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 395 days.

(21) Appl. No.: 16/563,935

(22) Filed: Sep. 9, 2019

(65) Prior Publication Data

US 2020/0102876 A1 Apr. 2, 2020

(30) Foreign Application Priority Data

Sep. 27, 2018 (JP) ..... JP2018-181719

(51) Int. Cl.
*F01N 13/08* (2010.01)
*F01N 1/08* (2006.01)

(52) U.S. Cl.
CPC ..... *F01N 13/08* (2013.01); *F01N 1/083* (2013.01); *F01N 2260/20* (2013.01)

(58) Field of Classification Search
CPC ..... F01N 1/083; F01N 1/084; F01N 1/089; F01N 13/08; F01N 2490/02; F01N 2490/04; F01N 2490/06; F01N 2490/08; F01N 2490/10
USPC ..... 181/264, 265, 269
See application file for complete search history.

(56) References Cited

U.S. PATENT DOCUMENTS 734,878 A * 7/1903 Jamison ..... F01N 1/084 181/265
792,804 A * 6/1905 Williams ..... F01N 1/084 181/265
1,839,192 A * 1/1932 Baits ..... F01N 1/083 181/272
2,205,899 A * 6/1940 Chipley ..... F01N 1/24 181/269
2,239,549 A * 4/1941 Chipley ..... F01N 1/089 181/269
3,462,947 A * 8/1969 Nowak ..... F01N 1/084 60/314
5,123,502 A * 6/1992 Flugger ..... F01N 1/06 181/264
5,304,749 A * 4/1994 Crandell ..... F01N 1/083 181/264
5,444,197 A * 8/1995 Flugger ..... F01N 1/06 181/264

(Continued)

FOREIGN PATENT DOCUMENTS

CN 102207016 A 10/2011
JP S5332248 U 3/1978

(Continued)

*Primary Examiner* — Jeremy A Luks
(74) *Attorney, Agent, or Firm* — Hauptman Ham, LLP

(57) ABSTRACT

A muffler for a vehicle includes a first expansion chamber in which an exhaust gas flowing in from an inlet pipe is expanded, and a bracket that is placed on an inner surface of the first expansion chamber to oppose a blow-off port of the inlet pipe and that has a mountain shape protruding toward a side of the inlet pipe. The bracket includes a top surface which opposes the blow-off port of the inlet pipe, and inclined surfaces which incline from the top surface toward corners of the first expansion chamber.

6 Claims, 4 Drawing Sheets

(56) References Cited

U.S. PATENT DOCUMENTS

| | | | | |
|---|---|---|---|---|
| 6,776,257 | B1 * | 8/2004 | Shaya | F01N 1/083 181/264 |
| 7,219,764 | B1 * | 5/2007 | Forbes | F01N 1/02 181/270 |
| 2006/0008397 | A1 * | 1/2006 | Bruck | F01N 3/2821 422/180 |

FOREIGN PATENT DOCUMENTS

| | | | |
|---|---|---|---|
| JP | 2007-92628 | A | 4/2007 |
| JP | 2016-217152 | A | 12/2016 |
| JP | 201844446 | A | 3/2018 |

* cited by examiner

A-A CROSS SECTION

MUFFLER FOR VEHICLE

CROSS REFERENCE TO RELATED APPLICATION

This application claims priority to Japanese Patent Application No. 2018-181719 filed on Sep. 27, 2018, which is incorporated herein by reference in its entirety including the specification, claims, drawings, and abstract.

TECHNICAL FIELD

The present disclosure relates to a structure of a muffler for a vehicle.

BACKGROUND

A muffler for a vehicle is used in which sound reduction is achieved by expanding an exhaust gas from the engine which flows in from an inlet pipe. In such a muffler for a vehicle, there may be cases where, when the exhaust gas introduced into an expansion chamber reaches an inner surface of the expansion chamber, the exhaust gas causes vibration of a plate member of the expansion chamber, resulting in generation of a radiation sound. In consideration of this, structures are proposed (for example, JP 2016-217152 A) in which a plate member having projection and recesses is attached to the inner surface of the expansion chamber to increase rigidity of the plate member of the expansion chamber, and to consequently suppress generation of the radiation sound.

In recent years, further reduction of vehicle noise is demanded. In order to increase an amount of sound reduction for the muffler for a vehicle which reduces the sound by expanding the exhaust gas, a configuration may be considered in which a volume of the expansion chamber is increased. However, due to the mounting space of the vehicle, increasing the volume of the expansion chamber is difficult. In light of this, an advantage of the present disclosure lies in increasing an amount of sound reduction without an increase in the volume of the expansion chamber in a muffler for a vehicle.

SUMMARY

According to one aspect of the present disclosure, there is provided a muffler for a vehicle, comprising: an expansion chamber in which an exhaust gas which flows in from an inlet pipe is expanded; and a bracket that is placed on an inner surface of the expansion chamber opposing a blow-off port of the inlet pipe into an interior of the expansion chamber, and that has a mountain shape protruding toward a side of the inlet pipe, wherein the bracket includes a top surface which opposes the blow-off port of the inlet pipe, and inclined surfaces which incline from the top surface toward corners of the expansion chamber.

With this structure, the exhaust gas flowing into the expansion chamber from the inlet pipe can be introduced to the corner of the expansion chamber along the inclined surface of the bracket, and, consequently, the exhaust gas can be diffused to an entire region of the expansion chamber and the amount of sound reduction of the muffler for the vehicle can be increased. Because of this, the amount of sound reduction can be increased without increasing the volume of the expansion chamber. In addition, the exhaust gas from the inlet pipe can be caused to contact an end plate in an inclined manner, and thus, it is possible to suppress generation of the radiation sound due to vibration of the end plate caused by a dynamic pressure of the exhaust gas.

According to another aspect of the present disclosure, in the muffler for the vehicle, the expansion chamber is formed by a tube portion, and end plates attached to respective ends of the tube portion, the inlet pipe is connected to one end plate, and the bracket is a mountain shape plate member in which a base of the mountain is attached to an inner surface of the other end plate, to form a closed cross-sectional structure with the other end plate.

In this manner, by forming the closed cross-sectional structure by the bracket and the end plate, it is possible to increase the rigidity of the end plate, and to consequently suppress vibration of the end plate and to reduce the radiation sound.

According to another aspect of the present disclosure, in the muffler for the vehicle, the inlet pipe is connected at a position which is offset from a center of one end plate toward an outer circumferential side, the top surface of the bracket is placed at a position which is offset from a center of the other end plate toward an outer circumferential side, to oppose the blow-off port of the inlet pipe, and a part of the inclined surfaces of the bracket extends from the top surface, over a virtual line passing through a center in a left-and-right direction on an inner surface of the other end plate or a virtual line passing through a center in an up-and-down direction, and toward the corners of the expansion chamber.

With this structure, even when the inlet pipe is connected to the position which is offset from the center of the end plate toward the outer circumferential side, the exhaust gas can be diffused over the entire region of the expansion chamber, the amount of sound reduction of the muffler for the vehicle can be increased, and the generation of the radiation sound from the end plate can be suppressed.

According to the present disclosure, the amount of sound reduction can be increased without an increase of the volume of the expansion chamber in the muffler for the vehicle.

BRIEF DESCRIPTION OF DRAWINGS

Embodiment(s) of the present disclosure will be described by reference to the following figures, wherein.

DESCRIPTION OF EMBODIMENTS

Figure 1:
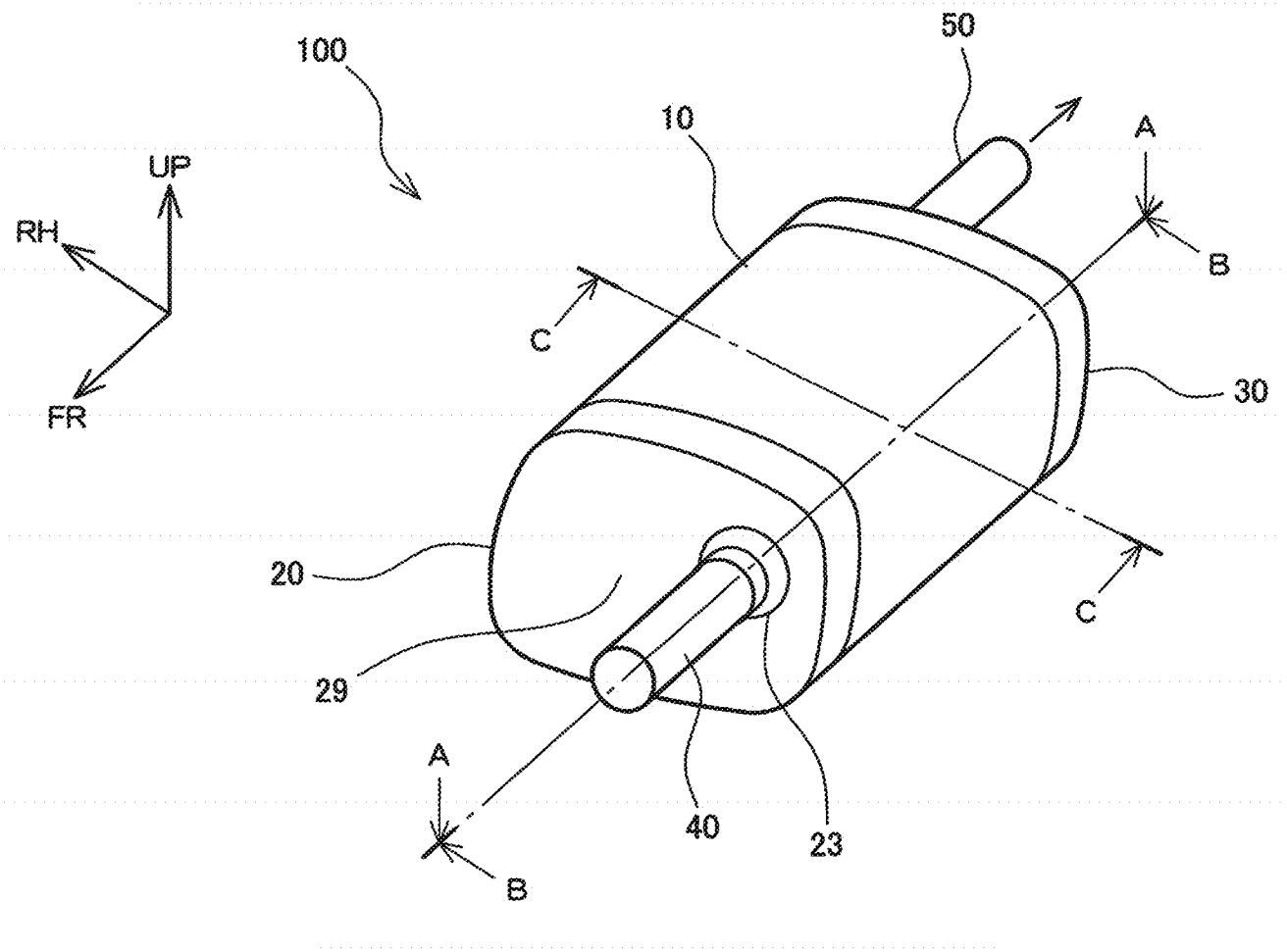
FIG. 1 is a perspective diagram of a muffler for a vehicle according to an embodiment of the present disclosure.

A muffler 100 for a vehicle according to an embodiment of the present disclosure will now be described with reference to the drawings. An arrow FR, an arrow UP, and an arrow RH shown in the drawings respectively show a front direction (direction of travel) of the vehicle, an upward direction, and a right direction. Directions opposite from the arrows FR, UP, and RH respectively show a rear direction of the vehicle, a downward direction, and a left direction. In the following, in the descriptions simply using the directions of front and rear, left and right, and up and down, unless otherwise specified, these directions mean the front and rear of the front-and-rear direction of the vehicle, the left and right in the left-and-right direction of the vehicle (width direction of the vehicle), and the up and down in the up-and-down direction of the vehicle.

As shown in FIG. 1, the muffler 100 for the vehicle comprises a tubular body 10, a front lid 20 which is attached at a vehicle front side of the body 10, a rear lid 30 which is attached at a vehicle rear side of the body 10, an inlet pipe 40, and an outlet pipe 50.

Figure 2:
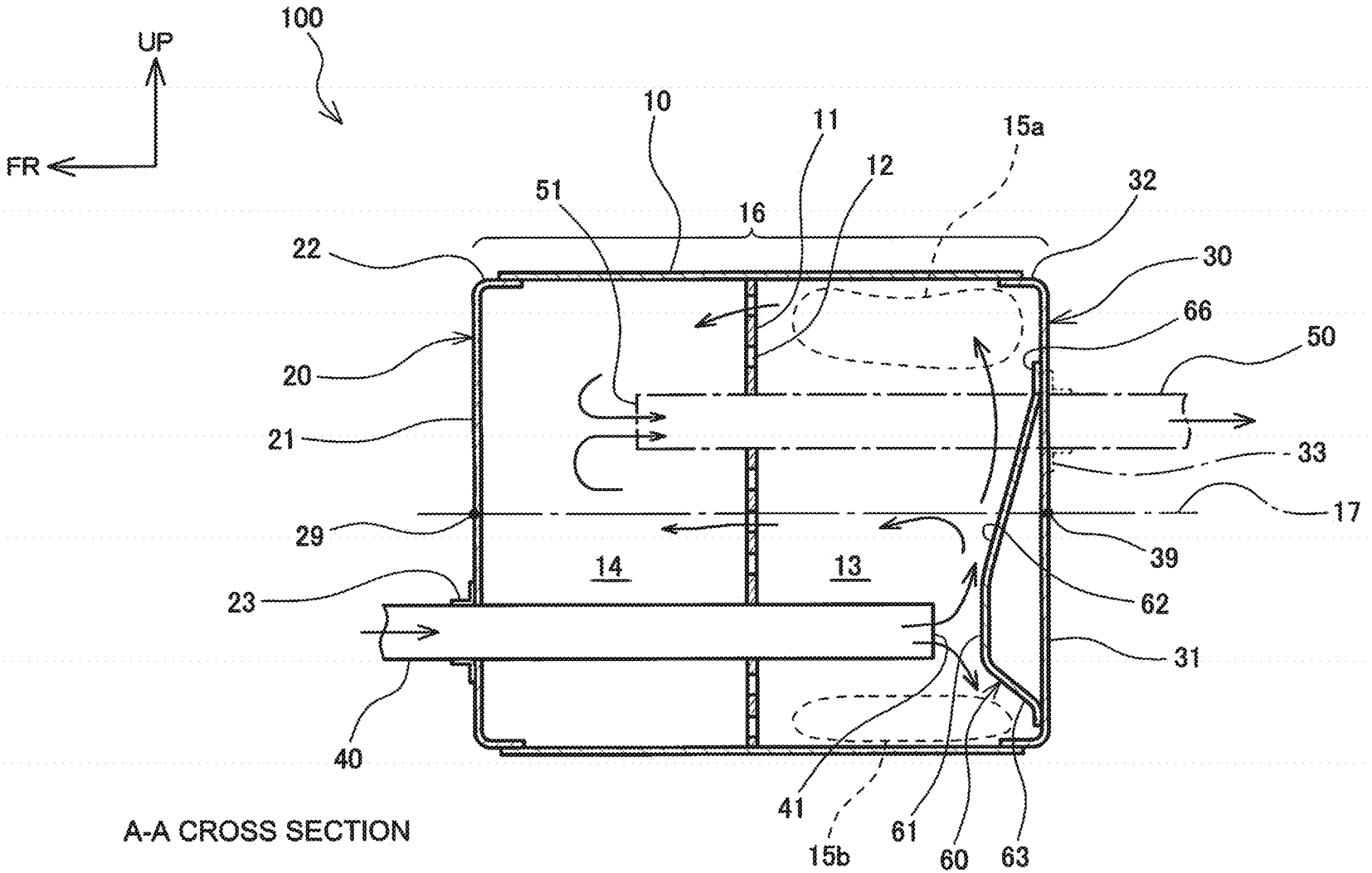
FIG. 2 is a planar cross-sectional diagram passing through a center of an inlet pipe of the muffler for the vehicle of FIG. 1, showing an A-A cross section of FIG. 1.
Figure 3:
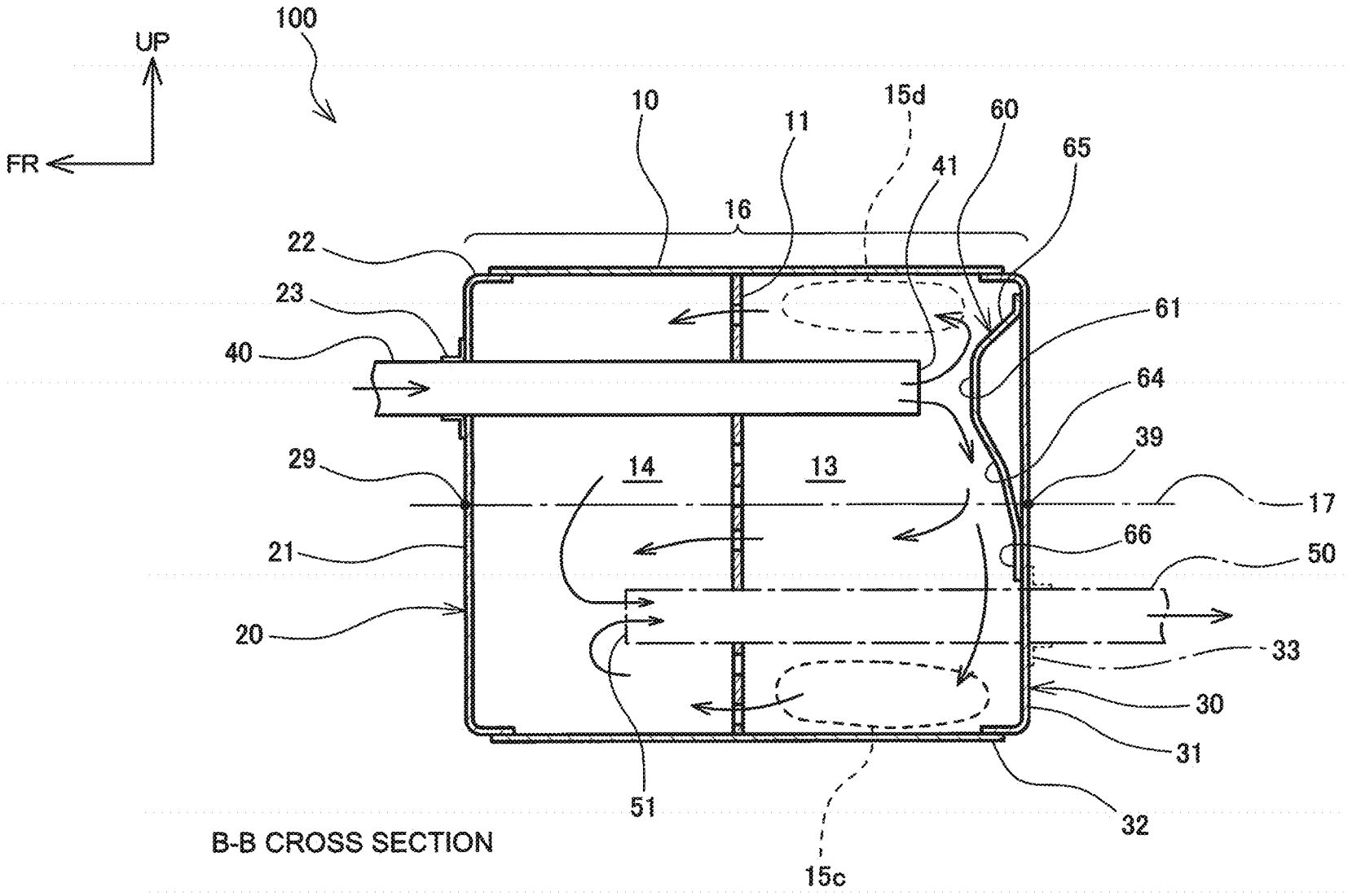
FIG. 3 is a side cross-sectional diagram passing through a center of the inlet pipe of the muffler for the vehicle of FIG. 1, showing a B-B cross section of FIG. 1.

As shown in FIGS. 2 and 3, the body 10 is a tubular member, and a partitioning plate 11 having a plurality of holes 12 is attached inside the body 10. The front lid 20 is a tubular member with a bottom, including a bottom plate 21 and a side plate 22 which extends upward from an edge of the bottom plate 21. Similar to the front lid 20, the rear lid 30 is a tubular member with a bottom, including a bottom plate 31 and a side plate 32 which extends upwards from an edge of the bottom plate 31. The side plate 22 of the front lid 20 is fitted to an inner circumferential side of an opening at a front side of the body 10 and is thereby connected to the body 10, and the side plate 32 of the rear lid 30 is fitted to an inner circumferential side of an opening at a rear side of the body 10 and is thereby connected to the body 10. A space at a rear side of the partitioning plate 11 forms a first expansion chamber 13, and a space at a front side of the partitioning plate 11 forms a second expansion chamber 14.

A portion formed by the body 10, the side plate 22 of the front lid 20, and the side plate 32 of the rear lid 30 forms a tube portion 16, and the bottom plates 21 and 31 are attached to respective ends of the tube portion 16. In addition, the bottom plate 21 of the front lid 20 and the bottom plate 31 of the rear lid 30 correspond to one end plate and the other end plate described in the claims.

The inlet pipe 40 is attached via an attachment member 23 to the front lid 20, at a position which is offset from a center 29 of the front lid 20 toward a top left side. A blow-off port 41 at a tip of the inlet pipe 40 penetrates through the partitioning plate 11 and extends into the first expansion chamber 13. Similarly, the outlet pipe 50 is attached via an attachment member 33 to the rear lid 30 at a position which is offset from a center 39 of the rear lid 30 toward a bottom right side. A flow-in port 51 at a tip of the outlet pipe 50 penetrates through the partitioning plate 11 and extends into the second expansion chamber 14. In this manner, the inlet pipe 40 and the outlet pipe 50 are attached to the lids 20 and 30 at positions offset toward the outer circumferential side from the centers 29 and 39 of the lids 20 and 30. In FIGS. 2 and 3, a one-dot-and-chain line 17 is a virtual line passing through each of the centers 29 and 39.

Figure 4:
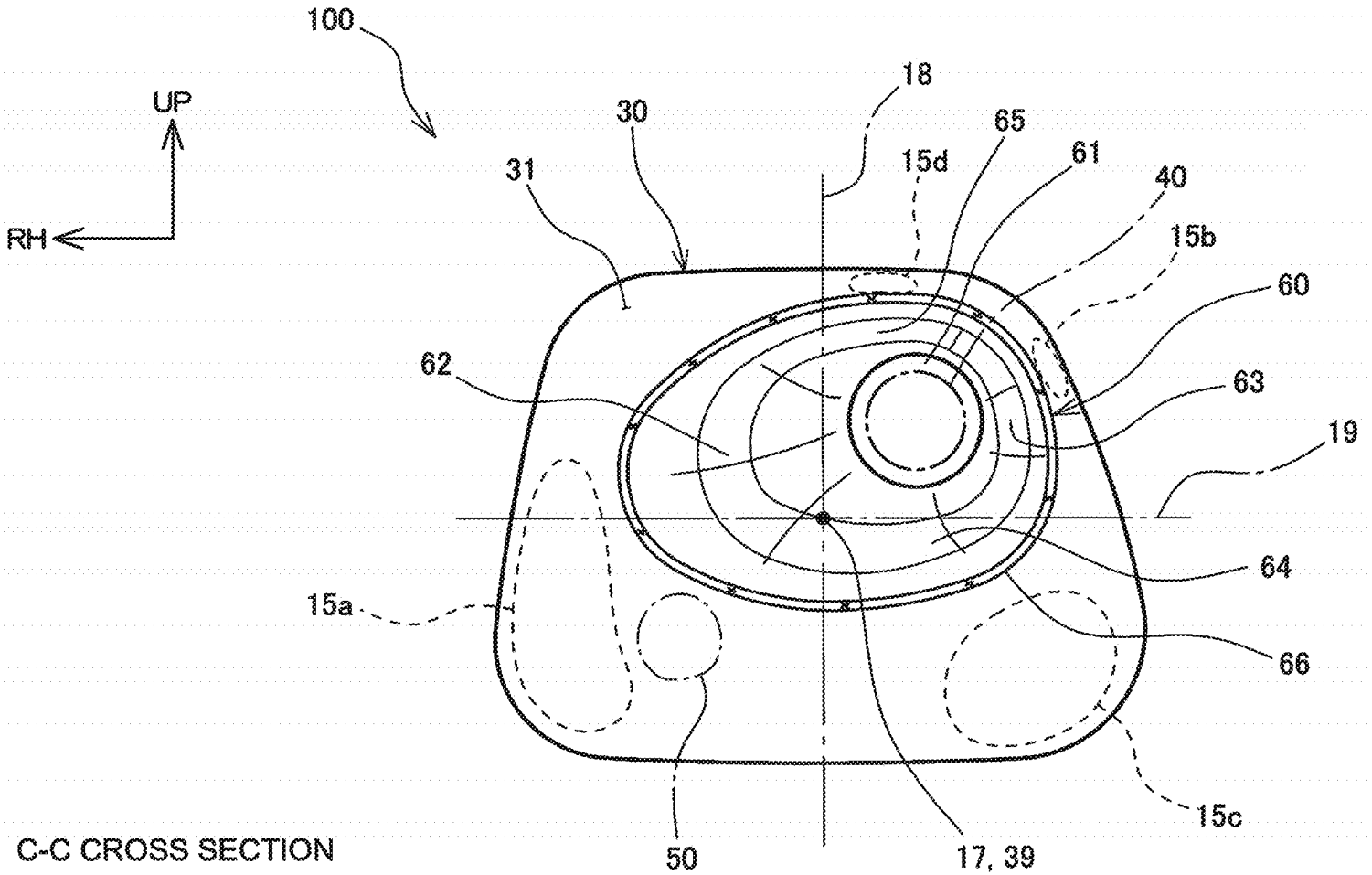
FIG. 4 is a front view showing the muffler for the vehicle of FIG. 1 from a front side of a vehicle toward a rear side, showing a C-C cross section view of FIG. 1.

A bracket 60 is attached on an inner surface of the bottom plate 31 of the rear lid 30. The bracket 60 is a plate member formed in a mountain shape, and includes a top surface 61 and inclined surfaces 62~65 connected to the top surface 61. Flanges 66 which extend along the inner surface of the bottom plate 31 are provided at bases of the inclined surfaces 62~65. As shown in FIG. 4, the bracket 60 is attached in such a manner that the top surface 61 opposes the blow-off port 41 of the inlet pipe 40. In addition, as shown in FIGS. 2 and 3, the bracket 60 is attached on the inner surface of the bottom plate 31 such that the top surface 61 protrudes toward the blow-off port 41. Therefore, the top surface 61 of the bracket 60 is positioned at a location which is offset from the center 39 of the rear lid 30 toward the top left side, similar to the inlet pipe 40. In FIG. 4, one-dot-and-chain lines 18 and 19 are lines orthogonal to the one-dot-and-chain line 17 passing through the center 39, and are respectively a virtual line passing through a center on the inner surface of the rear lid 30 in the left-and-right direction and a virtual line passing through a center in the up-and-down direction.

The flange 66 of the bracket 60 is attached by spot welding to the inner surface of the bottom plate 31, and, as shown in FIGS. 2 and 3, the bracket 60 forms a closed cross-sectional structure with the bottom plate 31 when the bracket 60 is attached to the inner surface of the bottom plate 31.

As shown in FIG. 4, the inclined surface 62 at the right side extends from the top surface 61, over the one-dot-and-chain line 18 which is a virtual line passing through the center in the left-and-right direction on the inner surface of the rear lid 30, and toward a corner 15*a* at a bottom right side of the first expansion chamber 13. The inclined surface 63 at the left side extends from the top surface 61 toward a corner 15*b* at a left side of the first expansion chamber 13. The inclined surface 64 at the lower side extends from the top surface 61, over the one-dot-and-chain line 19 which is a virtual line passing through the center in the up-and-down direction on the inner surface of the rear lid 30, and toward a corner 15*c* at a bottom left side of the first expansion chamber 13, and the inclined surface 65 at the upper side extends from the top surface 61 toward a corner 15*d* at the upper side. In the muffler 100 for the vehicle of the present embodiment, inclination angles of the inclined surfaces 62 and 64 are smaller than 45 degrees, and are about 20 to about 30 degrees. Further, the inclined surfaces 62 and 64 extend to regions near midpoints between an edge of the top surface 61 and the corners 15*a* and 15*c*.

As shown by arrows in FIGS. 2 and 3, the exhaust gas from the engine flowing into the inlet pipe 40 flows through the inlet pipe 40, and into the first expansion chamber 14 from the blow-off port 41. The exhaust gas entering the first expansion chamber 13 hits the top surface 61 of the bracket 60 opposing the blow-off port 41, and is diffused and flows toward the corners 15*a*~15*d* of the first expansion chamber 13 along the inclined surfaces 62~65. With this process, the exhaust gas is diffused over the entire region of the first expansion chamber 13 including the corners 15*a*~15*d*.

The exhaust gas diffused in the first expansion chamber 13 flows through the holes 12 formed on the partitioning plate 11 and into the second expansion chamber 14, and is diffused in the second expansion chamber 14. Thus, the sound is further reduced, and the exhaust gas flows from the flow-in port 51 into the outlet pipe 50 and is exhausted to the outside.

In this manner, in the muffler 100 for the vehicle of the present embodiment, the exhaust gas can be diffused to the entire region of the first expansion chamber 13 including the corners 15*a*~15*d* by the inclined surfaces 62~65 of the bracket 60. Therefore, the amount of sound reduction of the muffler 100 for the vehicle can be increased without increasing the volume of the first expansion chamber 13.

In addition, because the inclined surfaces 62 and 64 have inclinations of less than or equal to 45 degrees with respect to the bottom plate 31 of the rear lid 30, a dynamic pressure component of the exhaust gas in a direction orthogonal to the bottom plate 31 is reduced, and generation of the radiation sound due to vibration of the bottom plate 31 can be suppressed. In addition, because the dynamic pressure of the exhaust gas in the direction orthogonal to the bottom plate 31 can be received by the top surface 61 connected to the inclined surfaces 63 and 65 having large inclination angles and a level of high rigidity in the direction orthogonal to the bottom plate 31, it is possible to suppress the vibration of the bottom plate 31 and to consequently reduce the generation of the radiation sound.

Further, by forming a closed cross-sectional structure by the bracket 60 and the bottom plate 31, it is possible to increase rigidity of the bottom plate 31, and to consequently suppress vibration of the bottom plate 31 and to reduce the radiation sound.

As described, the muffler 100 for the vehicle according to the present embodiment can reduce the radiation sound from the bottom surface 31 in addition to allowing the increase in the amount of sound reduction of the muffler 100 for the vehicle without increasing the volume of the first expansion chamber 13. Therefore, the noise of the vehicle can be further reduced without increasing the volume of the first expansion chamber 13.

In the muffler 100 for the vehicle of the embodiment described above, the inclination angles of the inclined surfaces 62 and 64 are described to be about 20 to about 30 degrees, but the angles are not limited to these. Alternatively, the inclination angles of the inclined surfaces 62 and 64 may be any angle smaller than 45 degrees, such as, for example, about 10 degrees to about 20 degrees, or about 30 degrees to about 40 degrees. Further, the inclined surfaces 62 and 64 are described to extend to regions near midpoints between the edge of the top surface 61 and the corners 15*a* and 15*c*, but the present disclosure is not limited to this configuration, and alternatively, the inclined surfaces 62 and 64 may extend to regions near the corners 15*a* and 15*c*. Moreover, so long as the inclined surfaces 62 and 64 extend over the one-dot-and-chain line 18 which is the virtual line passing through the center in the left-and-right direction on the inner surface of the rear lid 30 and the one-dot-and-chain line 19 which is the virtual line passing through the center in the up-and-down direction, and toward the corners 15*a* and 15*c*, the inclined surfaces 62 and 64 may alternatively have shapes extending to regions slightly past the one-dot-and-chain lines 18 and 19.

Furthermore, the inlet pipe 40 is described to be attached at a position which is offset from the center 29 of the front lid 20 toward the outer circumferential side, but the present disclosure is not limited to such a configuration, and the inlet pipe 40 may alternatively be placed at the center 29 of the front lid 20. In this case, the top surface 61 is placed at the center 39 of the rear lid 30, and the inclined surfaces 62~65 are surfaces having the same inclination angle from the center 39 of the rear lid 30 toward the corners 15*a*~15*d*.

In addition, in the embodiment, the body 10 is partitioned by the partitioning plate 11 into the first expansion chamber 13 and the second expansion chamber 14, but alternatively, the partitioning plate 11 may be omitted, and one expansion chamber may be formed.

The invention claimed is:

1. A muffler for a vehicle, comprising:

an inlet pipe including a blow-off port;

an expansion chamber in which an exhaust gas which flows in from the inlet pipe is expanded; and a bracket placed on an inner surface of the expansion chamber opposing the blow-off port of the inlet pipe into an interior of the expansion chamber, the bracket having a mountain shape protruding toward the inlet pipe, wherein the bracket includes a top surface which opposes the blow-off port of the inlet pipe, and inclined surfaces which incline from the top surface toward corners of the expansion chamber, the expansion chamber includes a tube portion, and first and second end plates attached to respective ends of the tube portion, the first end plate is connected to the inlet pipe, a base of the mountain shape of the bracket is attached to an inner surface of the second end plate, and a part of the inclined surfaces of the bracket extends from the top surface toward the corners of the expansion chamber through a center in a left-and-right direction of the inner surface of the second end plate, or a center in an up-and-down direction of the inner surface of the second end plate.

2. The muffler for the vehicle according to claim 1, wherein the bracket is a mountain shape plate member defining a closed cross-sectional structure with the second end plate.

3. The muffler for the vehicle according to claim 2, wherein the inlet pipe is connected to the first end plate at a position which is offset from a center of the first end plate toward an outer circumference of the first end plate, and the top surface of the bracket is placed at a position which is offset from a center of the the second end plate toward an outer circumference of the second end plate, to oppose the blow-off port of the inlet pipe.

4. The muffler for the vehicle according to claim 1, wherein the part of the inclined surfaces of the bracket extends from the top surface toward the corners of the expansion chamber through the center in the left-and-right direction of the inner surface of the second end plate and the center in the up-and-down direction of the inner surface of the second end plate.

5. The muffler for the vehicle according to claim 1, wherein the part of the inclined surfaces of the bracket extends to a region corresponding to a midpoint between an edge of the top surface and the corners of the expansion chamber.

6. The muffler for the vehicle according to claim 5, wherein the part of the inclined surfaces has an inclination less than 45 degrees with respect to the second end plate of the expansion chamber.

* * * * *